United States Patent [19]

Potucek

[11] Patent Number: 4,833,906

[45] Date of Patent: May 30, 1989

[54] MACHINE FOR MAKING STAR-SHAPED FASTENERS

[75] Inventor: Frank R. Potucek, Palmetto, Fla.

[73] Assignee: Star Fasteners International, Inc., Savannah, Ga.

[21] Appl. No.: 192,797

[22] Filed: May 11, 1988

Related U.S. Application Data

[63] Continuation-in-part of Ser. No. 109,988, Oct. 19, 1987, Pat. No. 4,800,746.

[51] Int. Cl.[4] ..... B21B 15/00; B21G 3/30

[52] U.S. Cl. ..... 72/206; 10/43; 72/224

[58] Field of Search ..... 10/34, 43, 49, 54, 62; 72/194, 196, 197, 198, 206, 224, 234

[56] References Cited

U.S. PATENT DOCUMENTS

| | | | |
|---|---|---|---|
| 371,424 | 10/1887 | Clifford et al. | 72/224 |
| 2,014,746 | 9/1935 | Robergel | 10/54 X |
| 2,367,226 | 1/1945 | Lonsdale | 72/224 X |
| 2,800,668 | 7/1957 | Friedman | 10/43 |
| 2,821,727 | 2/1958 | Corckran | 10/54 X |
| 3,695,310 | 10/1972 | Donadio | 10/43 X |
| 4,034,587 | 7/1977 | Schwarz | 72/194 |
| 4,368,632 | 1/1983 | Thrash et al. | 72/198 |
| 4,637,768 | 1/1987 | Rabe | 10/62 X |

FOREIGN PATENT DOCUMENTS

| | | | |
|---|---|---|---|
| 46-19536 | 6/1971 | Japan | 72/224 |
| 2034223 | 6/1980 | United Kingdom | 10/54 |

*Primary Examiner*—E. Michael Combs

*Attorney, Agent, or Firm*—Ronald E. Smith; Joseph C. Mason, Jr.

[57] ABSTRACT

A wire straightener and multiple preform rollers prepare a continuous length wire for further forming by multiple form rollers having multiple spaced apart notches formed in an annular edge of the rollers. Some notches skip a section of the wire to be headed, and other notches serve to form barbs in the wire. In a first embodiment, after the formed wire is fed to a gripper housing where the wire is cut to a predetermined length, the skipped section is punched to create the fastener head. In a second embodiment, the formed wire is cut and fed to a rotary heading machine.

50 Claims, 12 Drawing Sheets

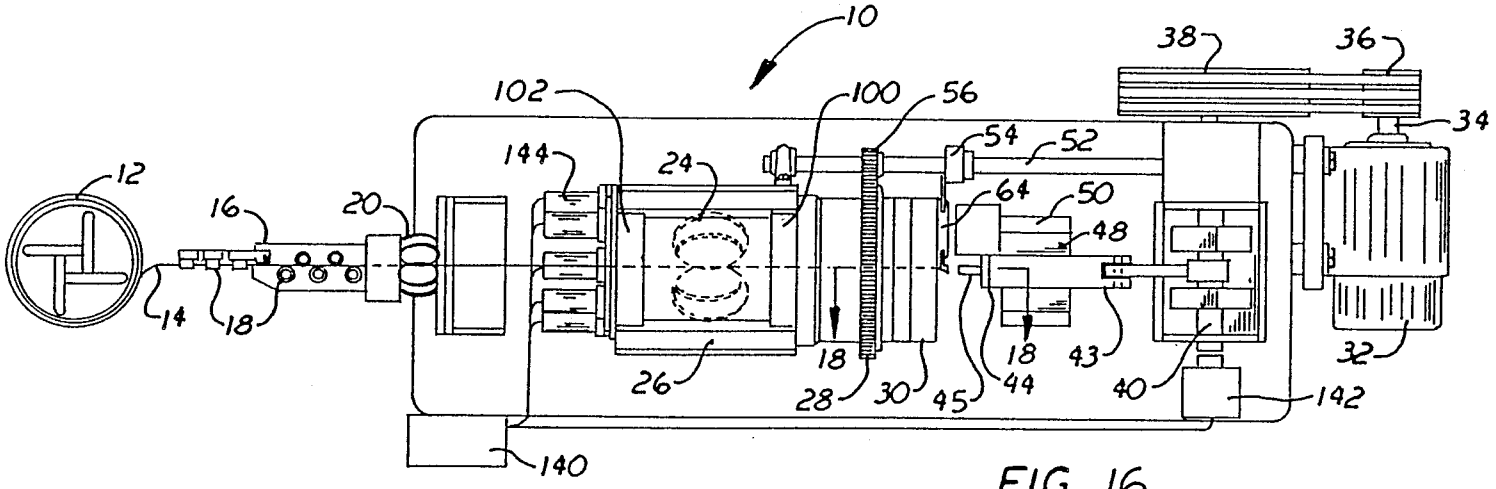
FIG. 16
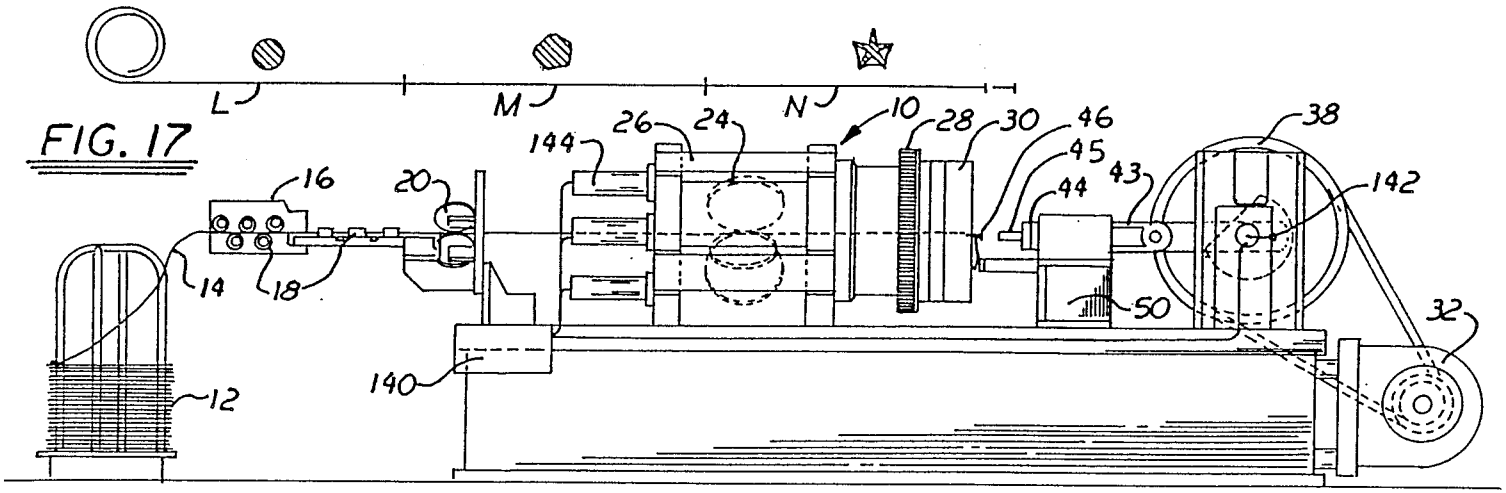
FIG. 17
FIG. 15

MACHINE FOR MAKING STAR-SHAPED FASTENERS

CROSS-REFERENCE TO RELATED APPLICATIONS

This disclosure is continuation-in-part of a co-pending disclosure by the same inventor bearing Ser. No. 07/109,988, filing date 10/19/87, U.S. Pat. No. 4,800,746 entitled Machine and Method for Making Star-Shaped Fasteners.

TECHNICAL FIELD

This invention relates to nail making machines. More particularly, it refers to machines and methods for making nails having a star-shaped cross section employing a skip rolling technique to prepare the nails for heading.

BACKGROUND ART

My prior U.S. Pat. No. 721,757, filed Apr. 10, 1985 (now abandoned); Ser. No. 001,693, filed Jan. 9, 1987, and Ser. No. 012,099, filed Feb. 6, 1987, describe star shaped fasteners. These fasteners employ substantially less metal than conventional fasteners and have greater strength and holding power in wood. Prior art machines such as shown in U.S. Pat. Nos. 1,579,071, 3,372,413 and 4,637,768 employ cooperative wire cutting elements, pointing dies, cooperative wire grippers and heading devices for heading stock wire while the wire is being held in the grippers. In each of these prior art patents a standard segment of the wire stock is formed, cut and then headed. When such a nail is grooved as in U.S. Pat. No. 4,637,768, there is a limited supply of metal for heading and this causes weakness at the head or a decrease in size of the head. Further, work hardening the wire heading section causes metal fatigue and cracking or splitting of the head. A method is needed which will allow enough metal to be available in grooved nail stock to provide for a normal head to be formed. Moreover, a method is needed to produce nails having a substantially uniform tensile strength along their extent.

Machines and methods are also needed which will provide nails having cross sections in the form of tapered fin stars and non-tapered fin stars as well. Furthermore, improved machines and methods for heading such star-shaped nails are needed.

DISCLOSURE OF INVENTION

I have discovered machines and methods for making star shaped nails employing a skip rolling technique. This technique provides a star shaped nail in cross section, but through a skip rolling step, the same amount of metal is supplied for heading as found in standard nail making operations.

My methods involve feeding a continuous length of wire into a wire straightener, feeding the wire among five rollers to form five flats in the wire, feeding the wire among five form rollers having equally spaced apart and aligned multiple notches on an outer edge of each roller and then feeding the wire to a gripper housing. Thereafter, the wire is held between grippers while it is headed, fed further, then cut and ejected from the housing.

In a second embodiment, the novel machine produces a fastener having a tapered fin star cross section where the fin-included angle is about 100° when the movably mounted form rollers are spaced apart by a first predetermined maximum distance, produces a fastener having a non-tapered fin cross section where the fin-included angle is about 70° when the form rollers are spaced apart a second predetermined minimum distance, and produces fasteners having differing fin tapers and fin-included angles between 70°-100° when the rollers are placed in any preselected position of functional adjustment between said maximum and minimum distances.

The second embodiment of this invention also includes replacing the heading unit of the first embodiment with a rotary heading device.

All of my star-shaped in section nails may be headed as discussed in connection with the first embodiment of my machine, or all of said nails may be headed as described in connection with the second embodiment of my machine.

The invention accordingly comprises the features of construction, combination of elements and arrangement of parts that will be exemplified in the descriptions set forth hereinafter and the scope of the invention will be set forth in the claims.

BRIEF DESCRIPTION OF THE DRAWINGS

The present invention may be best understood by those having ordinary skill in the art by reference to the following detailed description when considered in conjunction with the accompanying drawings in which.

A is the bulk wire reel,

B is the wire straightening rollers,

C is the group of performing wire rollers,

D is wire being pulled through the gear box area,

E is the group of notched roll forming wheels,

F is the wire pushed to the gripper housing,

G is the housing containing the wire grippers,

H is the head forming by a cycling ram striking an end of the wire at a non-formed portion, I is the wire feeding to its position for cutting, J is the five cutters forming the point of the nail while cutting the nail from wire, and K is the kicker driving free nail into container.

Figure 2:
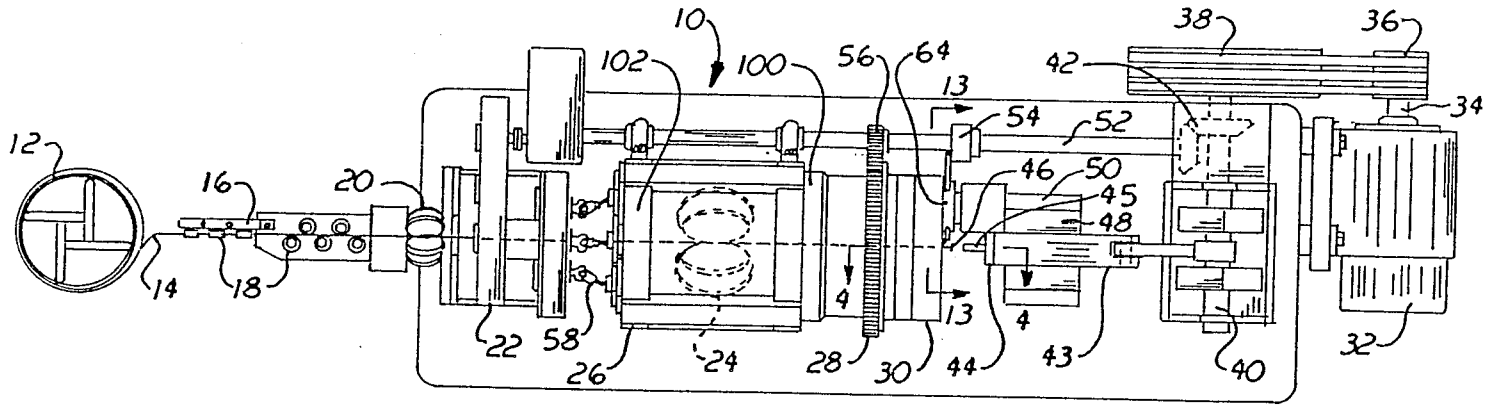
FIG. 2 is a top plan view of the machine for making nails.
Figure 4:
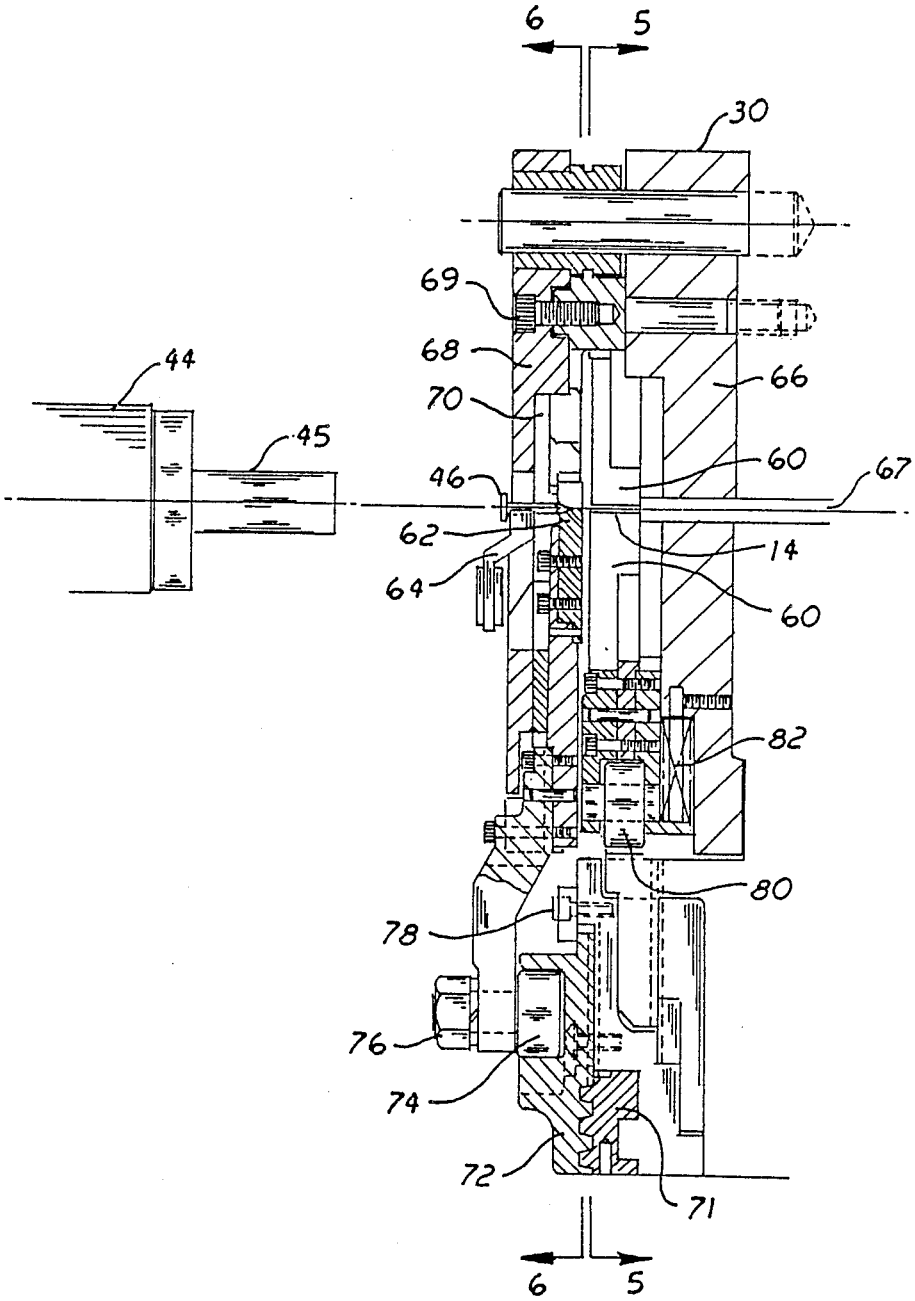

FIG. 4 is a section view along line 4—4 of FIG. 2.

Figure 5:
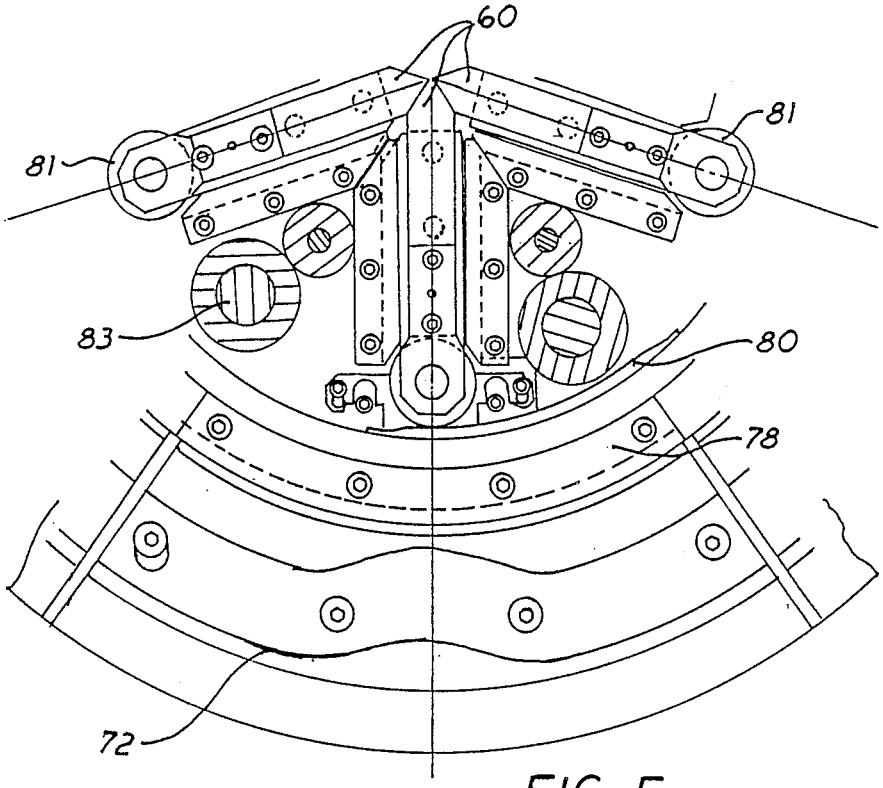

FIG. 5 is a partial section view along line 5—5 of FIG. 4 showing the wire grippers.

Figure 6:
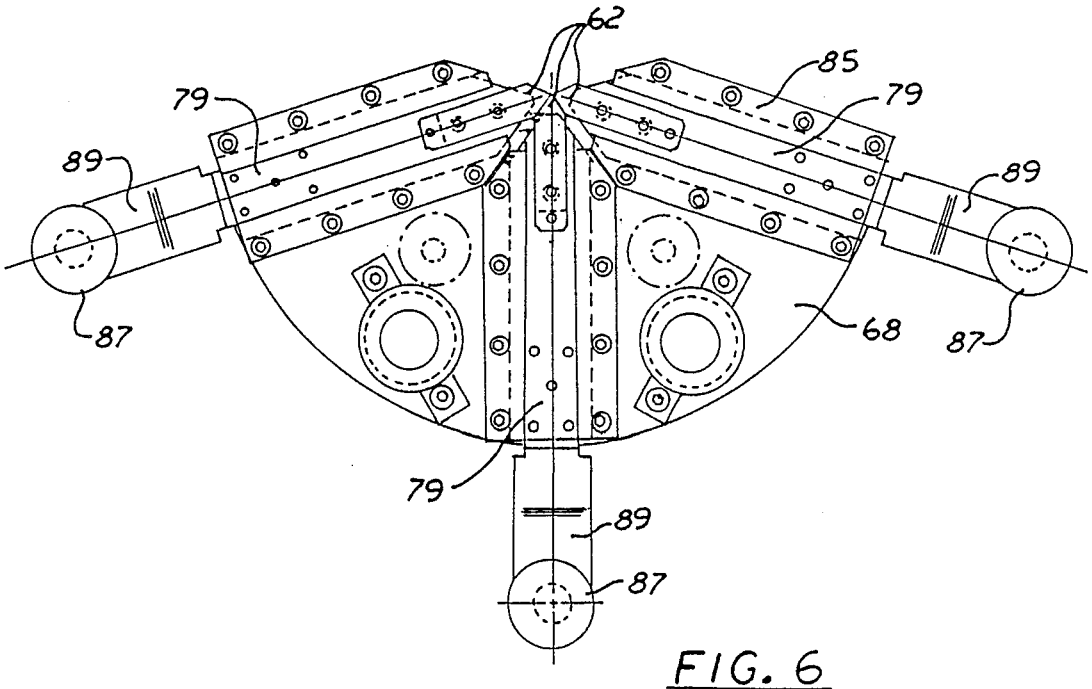

FIG. 6 is a partial section view along line 6—6 of FIG. 4 showing the wire cutters.

Figure 7:
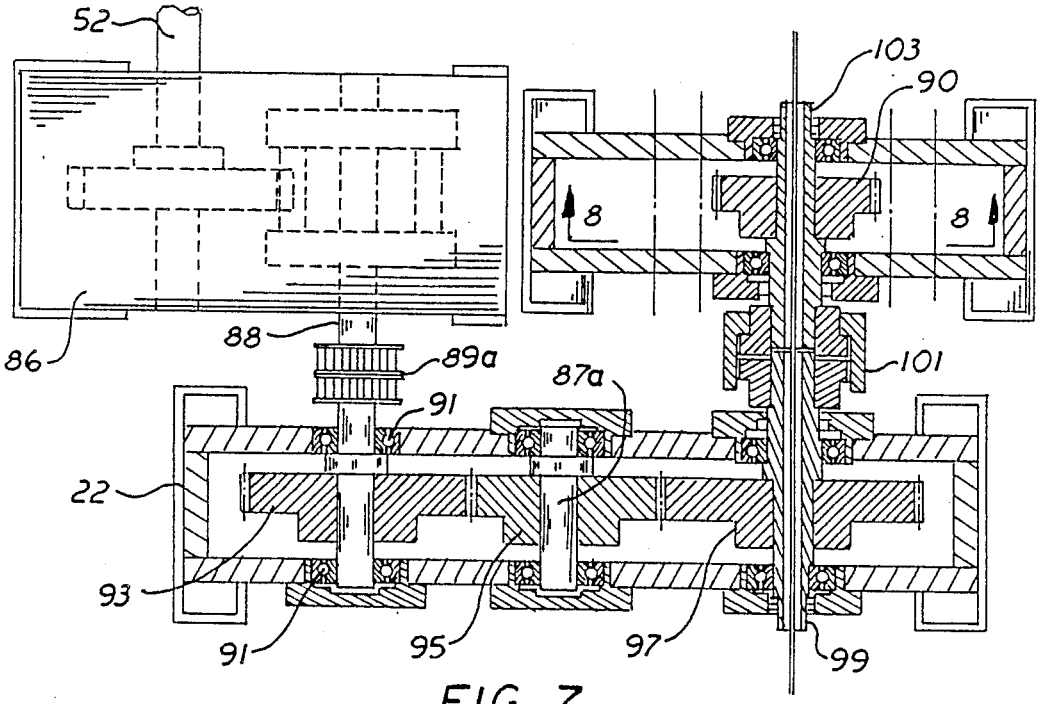

FIG. 7 is a partial section view of the gear boxes.

Figure 8:
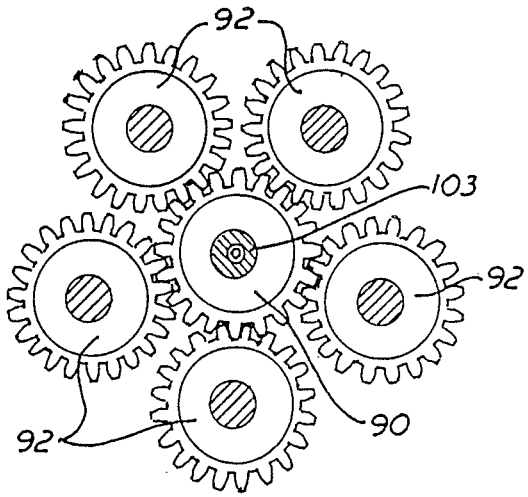

FIG. 8 is a view along line 8—8 of FIG. 7 showing the five drive timing gears.

Figure 9:
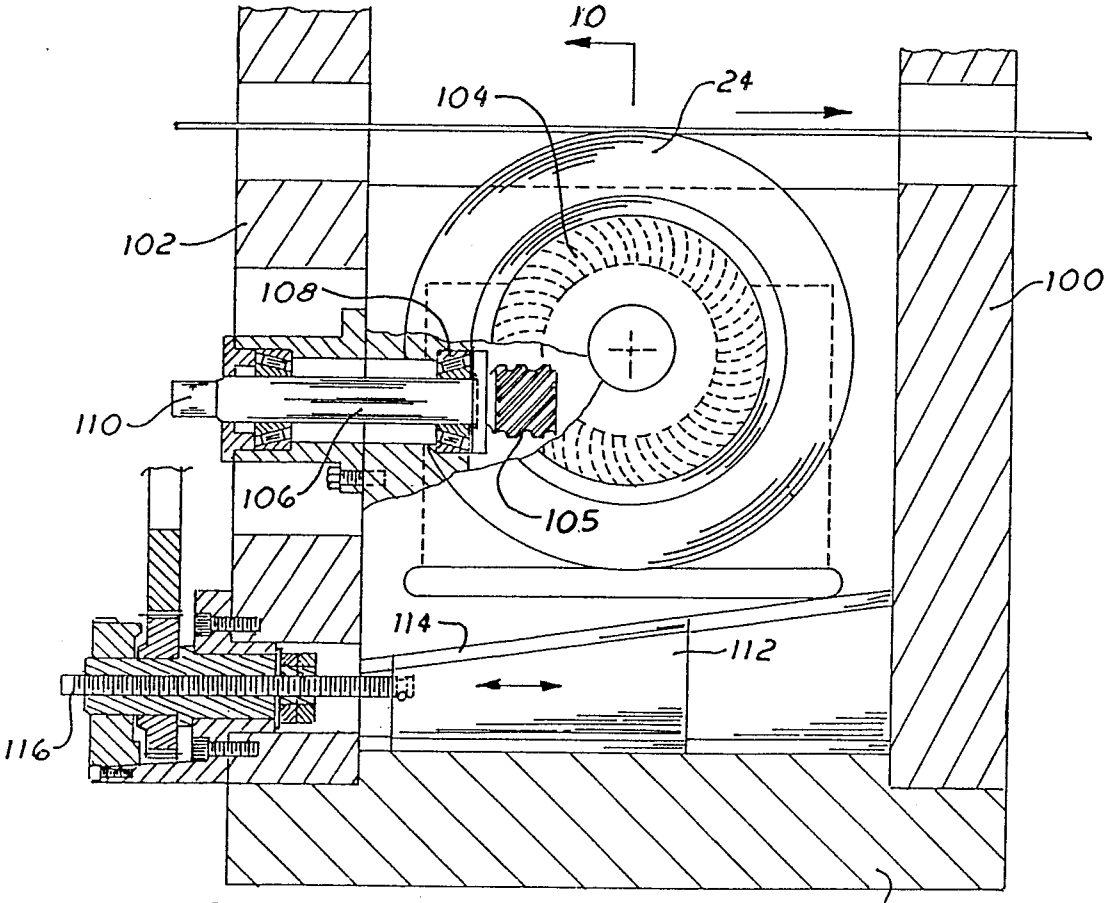

FIG. 9 is a partial section view of the roll form wheel drive and adjustment of FIG. 3E.

Figure 10:
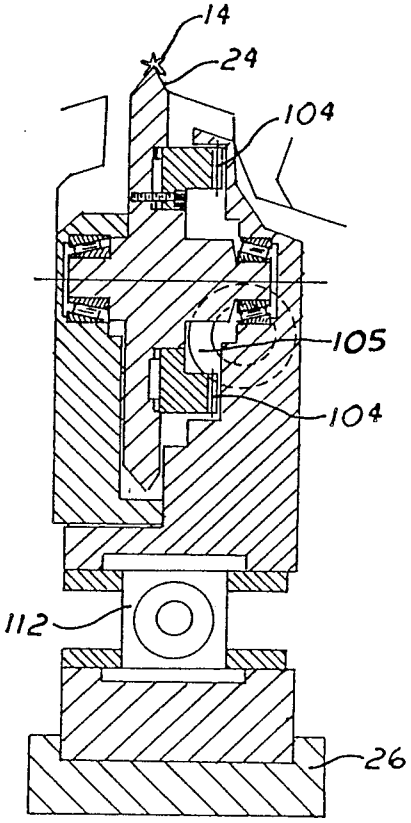

FIG. 10 is a section view along line 10—10 of FIG. 9.

Figure 11:
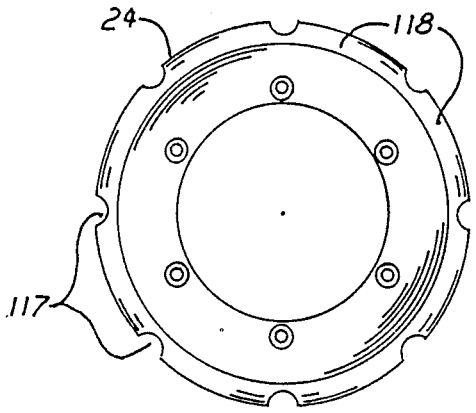

FIG. 11 is a side elevation view of a roll forming wheel with notches on its outer edge.

Figure 12:
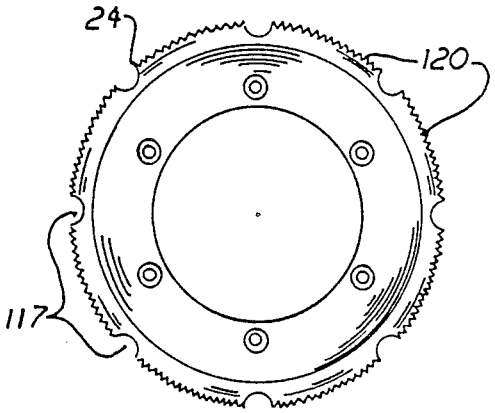

FIG. 12 is a side elevation view of a roll forming wheel with serrations and notches on its outer edge.

Figure 13:
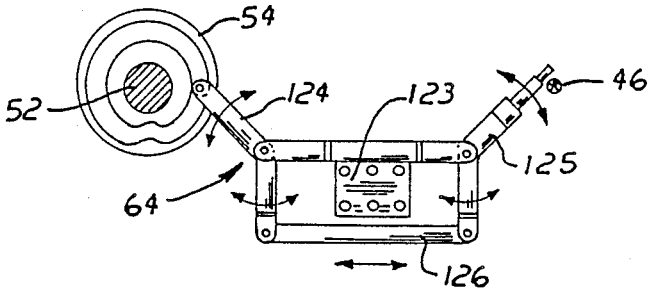

FIG. 13 is a view along line 13—13 of FIG. 2 showing the kicker assembly.

Figure 1:
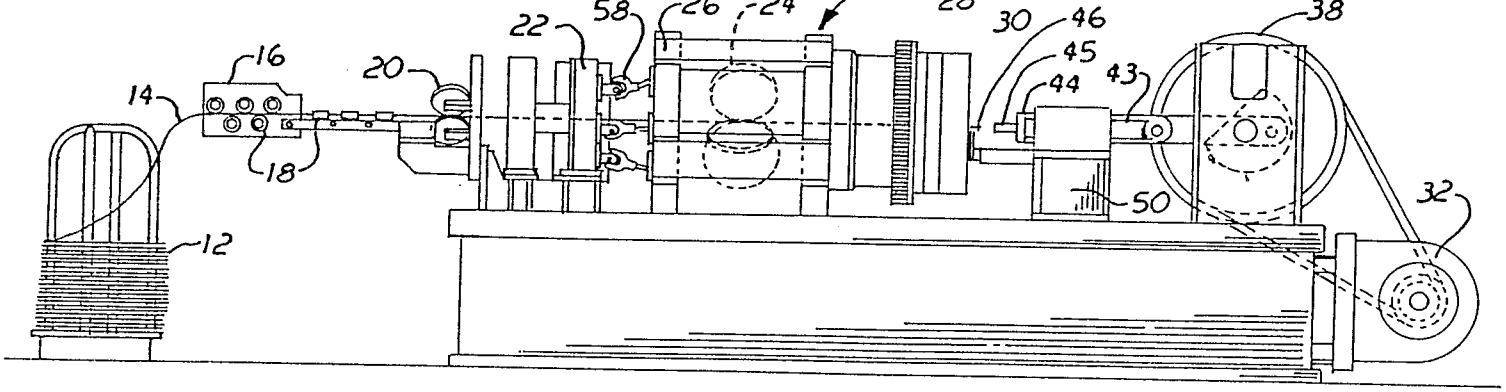
FIG. 1 is a side elevation view of a first embodiment of the machine for making nails.
Figure 14:
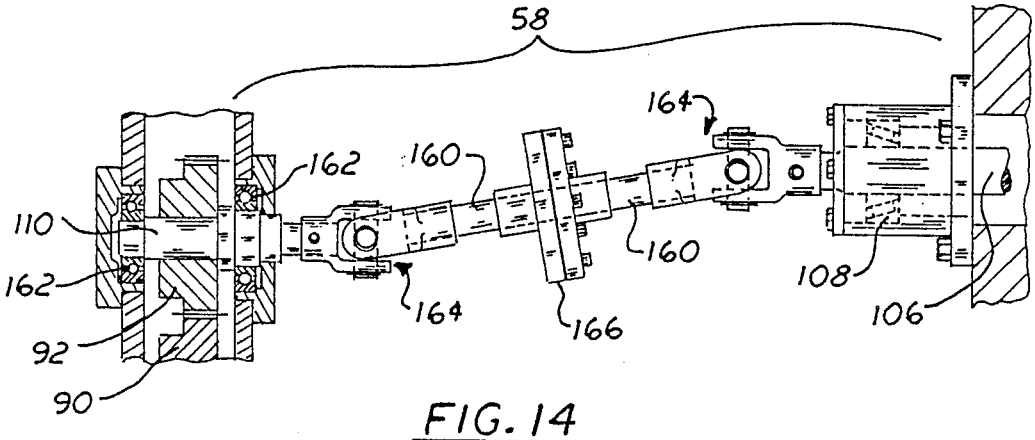

FIG. 14 is a view of a U-joint drive assembly shown in FIGS. 1 and 2.

FIG. 15 is a side elevation view of an alternate machine for making fasteners.

FIG. 16 is a top plan view of the machine of FIG. 15.

FIG. 17 is a flow diagram showing the change in the cross-sectional appearance of the feed wire in various sections of the machine.

Figure 18:
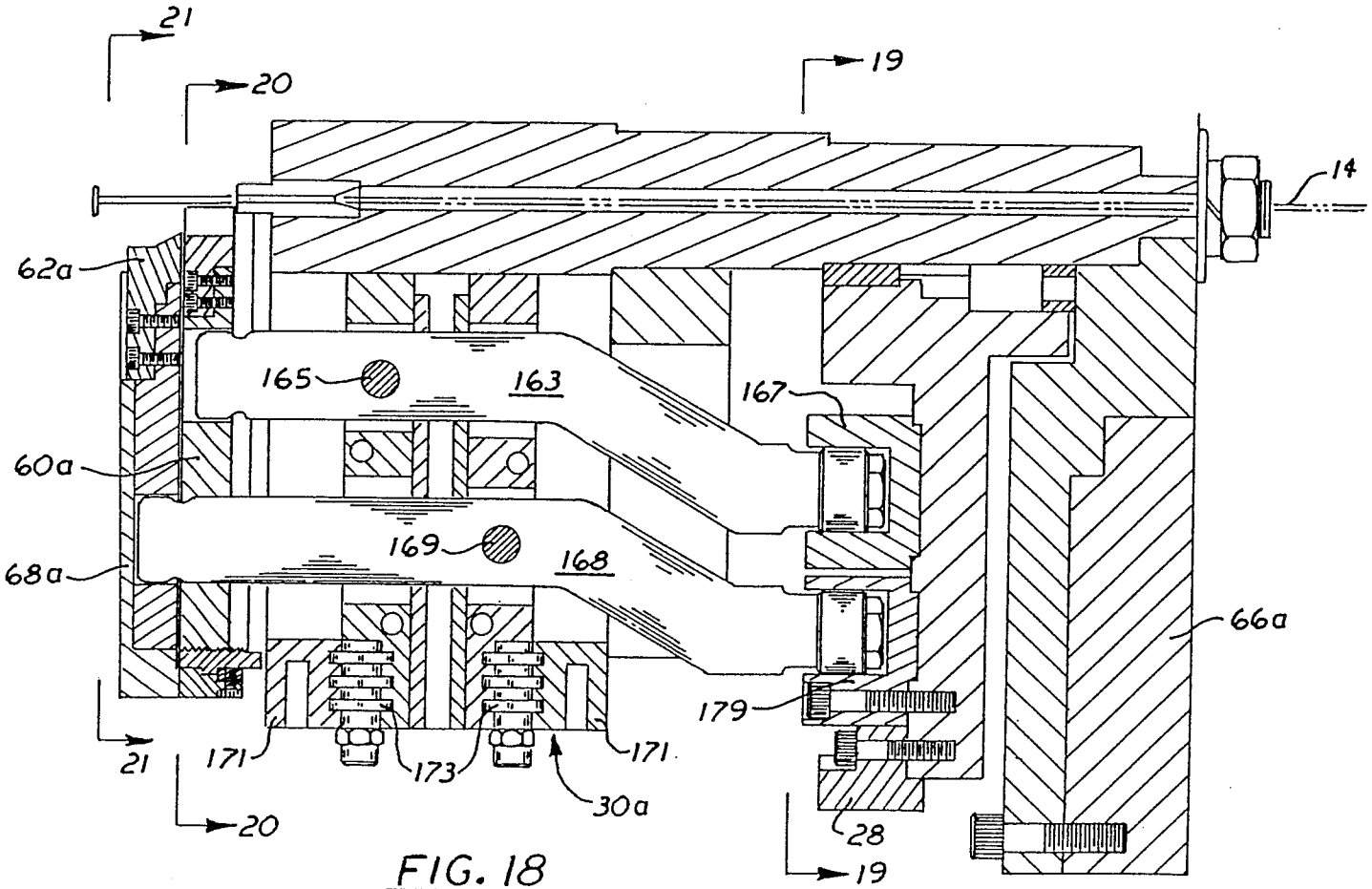

FIG. 18 is a cross-section through lines 18—18 in FIG. 16.

Figure 19:
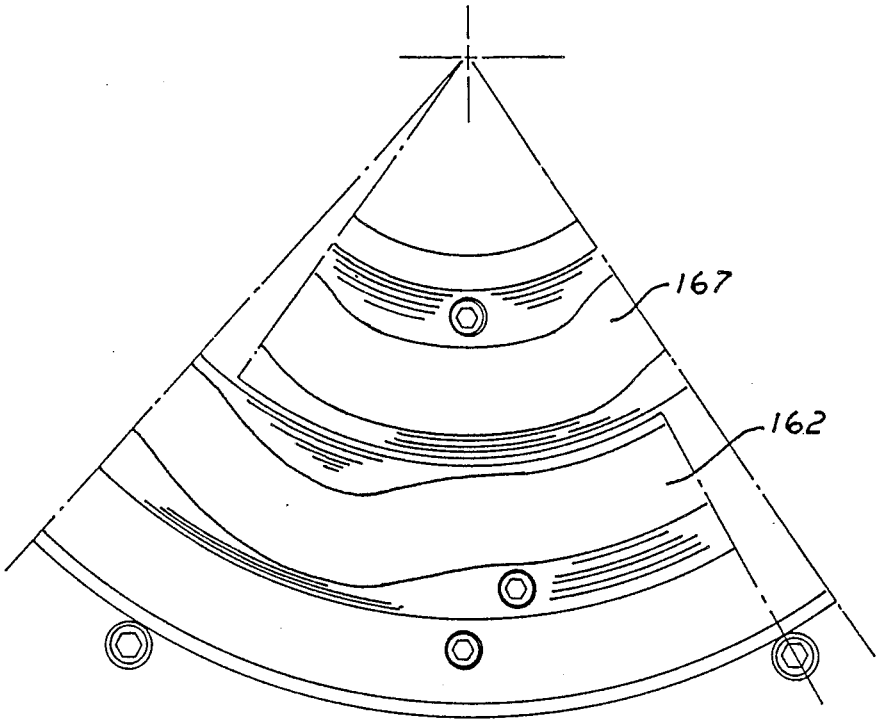

FIG. 19 is a section through lines 19—19 of FIG. 18.

Figure 20:
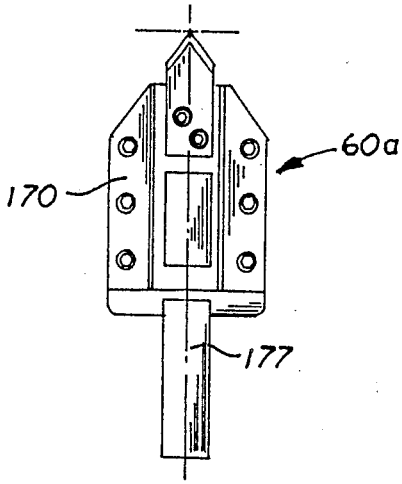

FIG. 20 is a view along lines 20—20 of FIG. 18 showing a gripper head.

Figure 21:
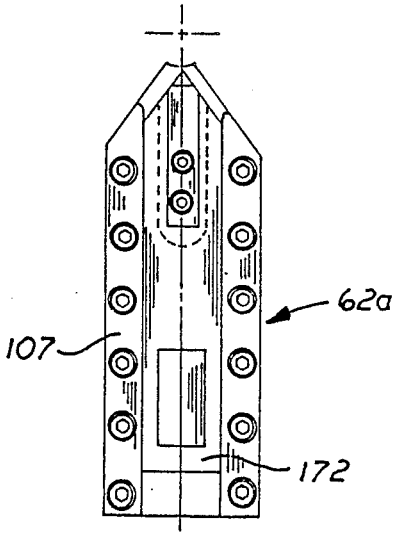

FIG. 21 is a view along lines 21—21 of FIG. 18 showing a cutter head.

Figure 22:
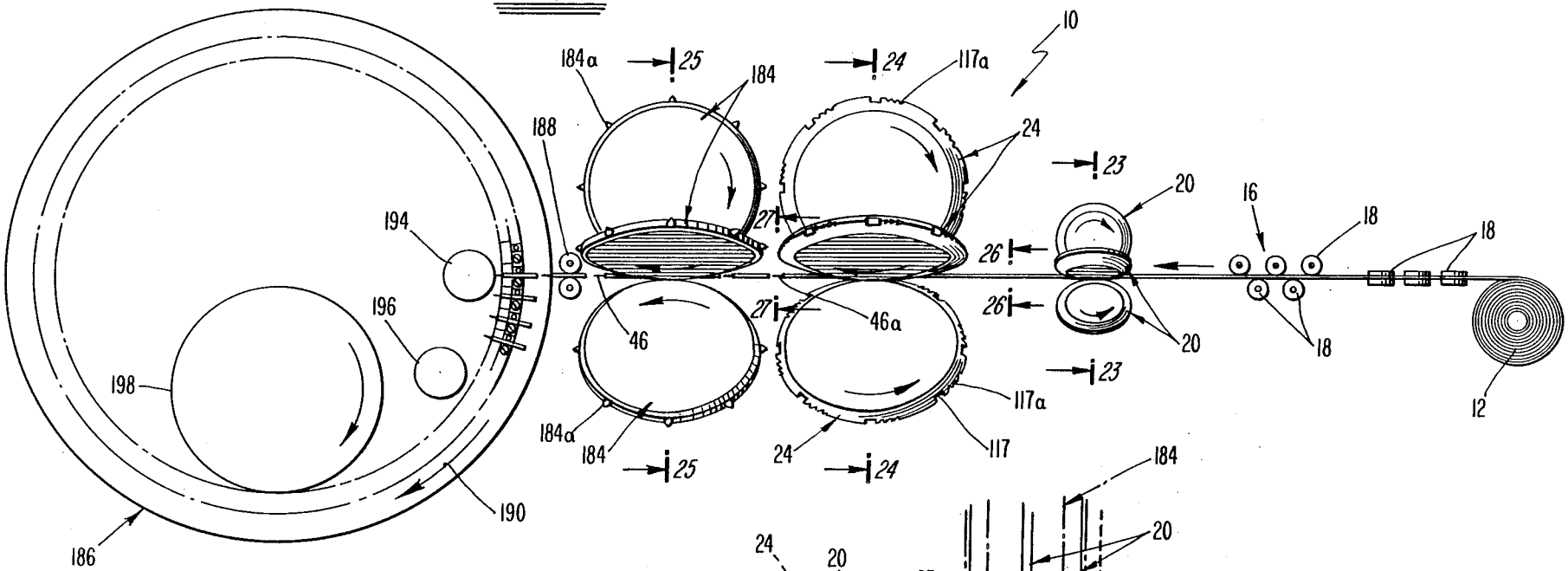

FIG. 22 is a conceptual drawing of a second embodiment of the machine for making nails.

Figure 23A:
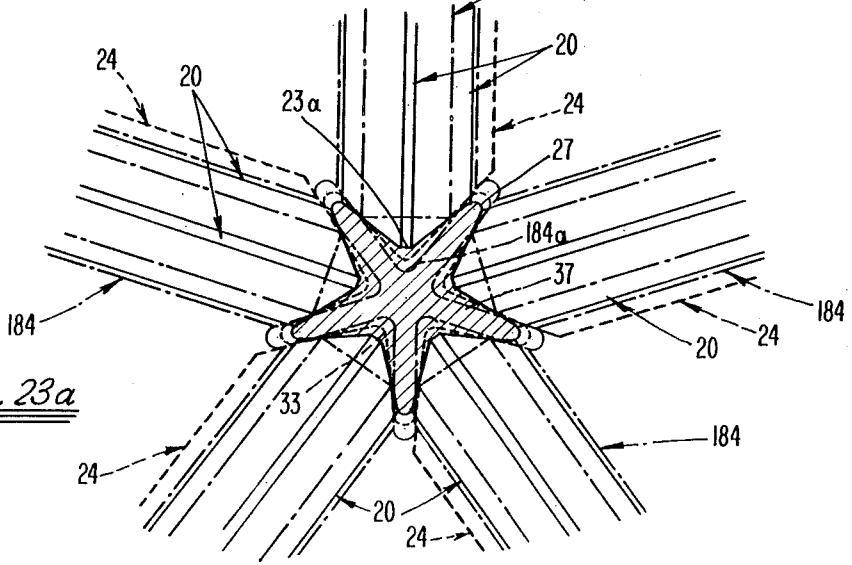
Figure 23:
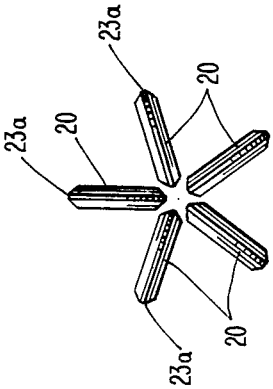

FIG. 23 is a sectional view taken along line 23—23 in FIG. 22;

FIG. 23*a* is a composite transverse sectional view of the wire, showing the pentagonal shape of the wire after passing through the preform roller station in broken lines, the shape of the wire produced when the form rollers are in their radially outermost position in solid lines, the shape of the wire produced when the form rollers are in an intermediate position in dotted lines, and the shape of the wire produced when the form rollers are in their radially innermost position in broken lines.

Figure 24:
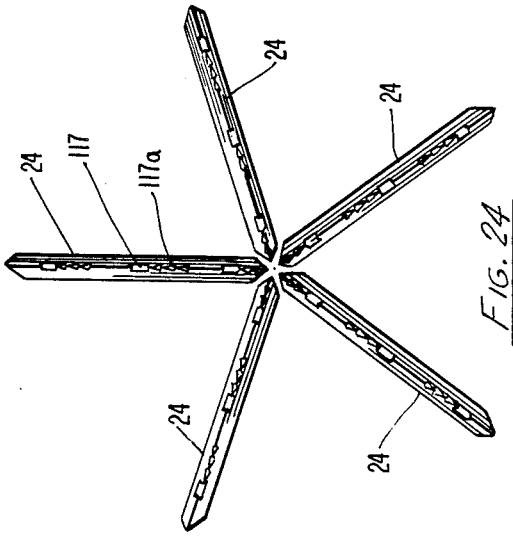

FIG. 24 is a sectional view taken along line 24—24 in FIG. 22.

Figure 3:
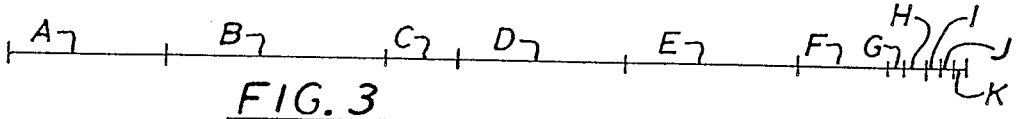
FIG. 3 is a basic operations chart where.
Figure 29:
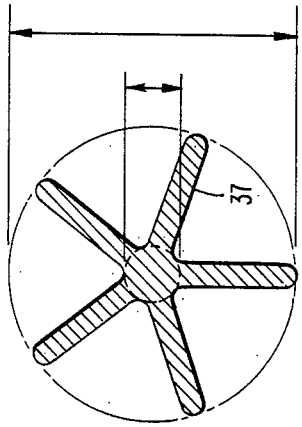
Figure 28:
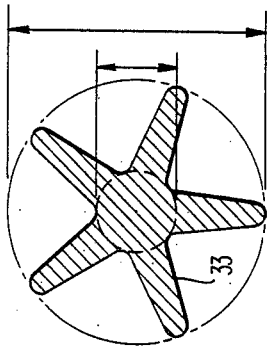
Figure 27:
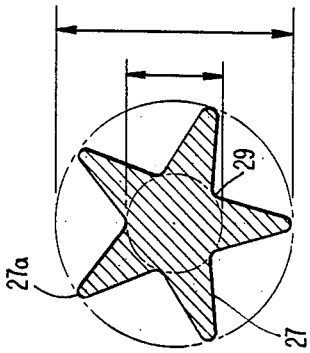
Figure 26:
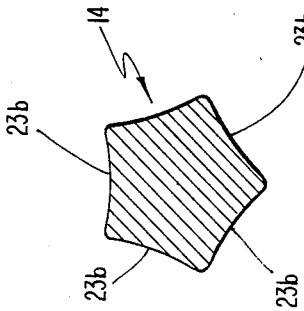
Figure 25:
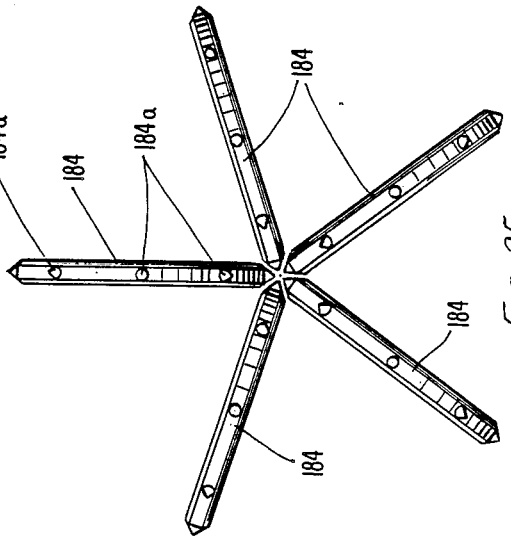
Figure 30:
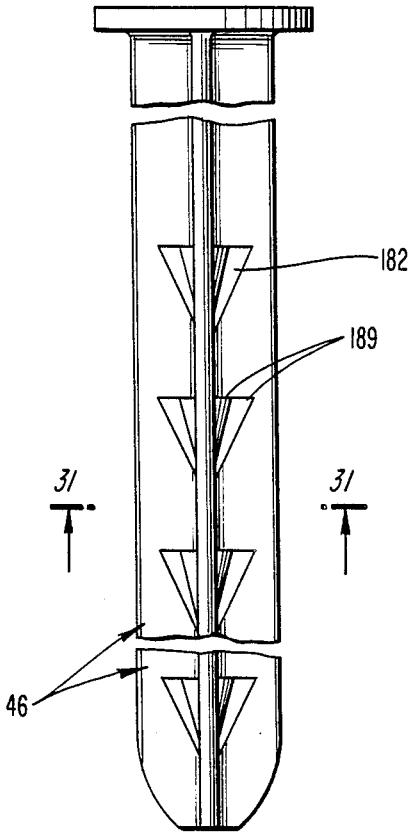
Figure 31:
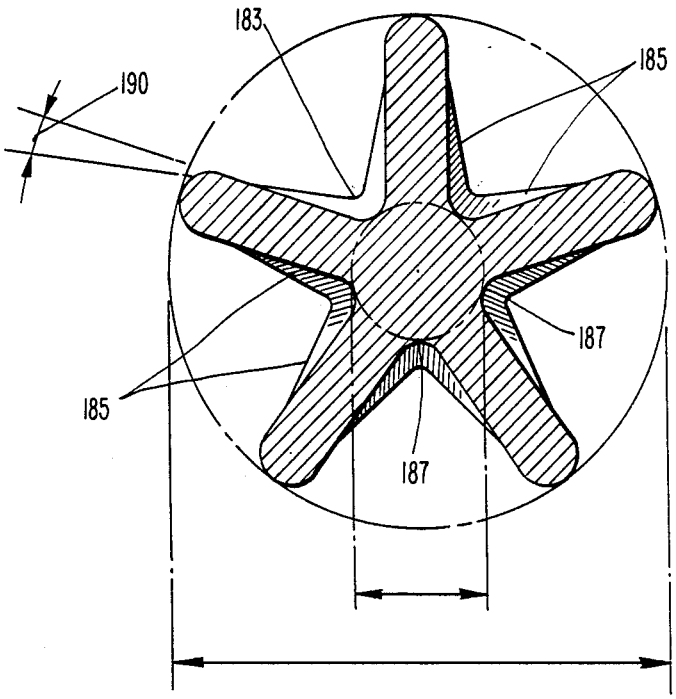

FIG. 25 is a sectional view taken along line 25—25 in FIG. 22;

FIG. 26 is a sectional view taken along line 26—26 in FIG. 22;

FIG. 27 is a sectional view taken along line 27—27 in FIG. 22 when the form rollers are positioned in their maximum spaced relation;

FIG. 28 is a sectional view taken along line 27—27 in FIG. 22 when the form rollers are positioned substantially intermediate their radially outermost and innermost positions;

FIG. 29 is a sectional view taken along line 27—27 in FIG. 22 when the form rollers are positioned in their minimum spaced relation;

FIG. 30 is an enlarged elevational view of a product that results when certain methods of this invention are followed;

FIG. 31 is a sectional view taken along line 31—31 in FIG. 3.

Similar reference numerals refer to similar parts throughout the several views of the drawings.

BEST MODES FOR CARRYING OUT THE INVENTION

The nail making machine 10 used in a method of my invention contains numerous component parts that cooperate together to make a star-shaped nail in cross section with a head having a size and strength equal to standard nails which are not grooved.

My machine 10 is fed by a wire roll 12 from which wire 14, having a gauge of 4 to 22, is fed to a wire straightening device 16. The wire straightener 16 as seen in FIGS. 1 and 2 has a series of rollers 18 in both a vertical and horizontal plane.

From the wire straightening device 16 the wire 14 is drawn through five preform rollers 20 so that the wire is given a five sided configuration, as shown in FIG. 17M. The wire 14 is then pulled through the gear box area 22 to the five forming rollers 24. These rollers 24 are mounted in a housing 26. After passing through rollers 24 the wire 14 has a star-shaped configuration in cross-section, as seen in FIG. 17N.

More specifically, the star has tapered fins spaced about 98° apart from one another. The diameter of an imaginary circle coincident with the radially outermost edges of said fins is about three times greater than the diameter of the core of the wire. This results in a nail having a surface area about seventeen percent (17%) greater than the surface area of a common round shank nail. Still further details about this novel star-shaped nail appear in the disclosures mentioned hereinabove.

The wire 14 is then pushed through gear 28 to the gripper housing 30. In the gripper housing 30 the wire is headed, fed further and cut. The heading and cutting operation will be discussed more fully hereafter.

Machine 10 is driven by a motor 32 having a shaft 34 driving pulley 36, which in turn drives flywheel 38. Flywheel 38 drives a crankshaft 40 and a bevel gear 42. The crankshaft drives connecting rod 43 which drives hammer 44 which in turn drives the punch 45 that places the head on the nail 46. The hammer 44 sits in a bearing saddle 48 which is supported by a housing 50.

Bevel gear 42 drives shaft 52 in a clockwise direction. Shaft 52 operates cam 54. Shaft 52 also drives gear 56 which turns gear 28. Gear 56 turns at a 5 to 1 ratio.

Five-spindled gearbox 22 operates five drive assemblies 58. Each drive assembly, as shown in FIG. 14, has a shaft 110 which in turn drives a universal joint 164 which through shaft 160 drives phasing coupling 166, each drive assembly 58 driving a separate wheel 24.

Each method step in the machine operation is shown in FIG. 3, A through K.

Zones F through K on FIG. 3 are shown in FIG. 4. FIG. 4 shows hammer 44 and punch 45, which has headed nail 46.

Wire 14, having a star-shaped configuration cross section, is fed into the gripper housing 30 and is held by grippers 60 while cutter assembly 62 severs and tapers the wire at a prescribed length. A kicker 64 ejects finished nail 46 into a bin, not shown.

Gripper housing 30 contains, in addition to the items disclosed above, a frontplate 66 having a channel 67 therein through which wire 14 is fed. A cutter plate 68 held in place by bolt 69 is in the back portion of the gripper housing 30. This plate 68 covers the guide channel 70 for the cutter slide assembly 62. A rotating scroll 71 adjusts cutting cam 72, which in turn controls the cutting roller 74 held in place by bolt 76. A cam retainer 78 keeps grip cam 80 in place. A spring 82 is used to retract grippers 60 to release wire 14.

FIG. 5 shows three of the gripper assemblies 60. However, there are five of said assemblies in machine 10. There are also five gripper cams 80, five cam followers 81 and five cutting cams 72. Alignment rods 83 are present to keep the gripper assemblies 60 in proper alignment.

Surmounting the five grippers 60 are five cutter assemblies 62 shown in FIG. 6. Each cutter assembly 62 is held in place by dovetail gibbs 85 attached to cutter plate 68 retaining dovetail slide 79. Cam wheel 87 moves cutter stem 89 which in turn moves assembly 62.

FIGS. 7 and 8 show the gear boxes 22 and the cam indexer 86. Shaft 52 drives cam indexer 86 and then shaft 88 from the indexer drives the change gear box 22 through coupling 89*a*. Bearings 91 support shaft 88. Shaft 88 drives change gear 93 which turns idler gear 97. Gear 97 drives change gear shaft 99 which drives phasing coupling 101. The phasing coupling 101 drives center gear shaft 103 which drives sun gear 90. Idler shaft 87*a* permits a 180° lag in the eventual turning of drive shaft 103 and gear 90. Sun gear 90 drives planet gears 92 which are attached to the five form rollers 24 through drive assembly 58.

Each roller 24, as shown in FIGS. 9 and 10, is mounted in housing 26 which has an end plate 100 to the rear of rollers 24 and a front plate 102 in the front portion of rollers 24. A helicon gear 104 drives roller 24 and responds to the helicon pinion 105. Shaft 110 drives drive shaft 106 through bearing 108. Shafts 110 are attached to planet gears 92.

A wedge block 112 having an inclined plane 114 is adjusted by the lead screw 116 by pulling the wedge block 112 back and forth. Wedge block 112 acts to raise and lower roller 24.

As seen in FIG. 11, roller 24 has a series of notches 117 and an arc 118 between each notch 117. The number of notches 117 and the diameter of the wheel determines the length of the nail. Each notch 117 provides a section of the nail that is not affected by roller 24 and, therefore, provides a skip section of the wire 14 used to head the nail. Such an area provides an additional mass of metal for proper heading. Two of the five rollers normally have smooth edges 118, whereas three of the rollers have serrated edges 120, as shown in FIG. 12. These serrated edges provide additional surface area in the grooves of the nail for better contact with the wood.

The kicker mechanism 64 mounted on bracket 123 is shown in detail in FIG. 13. Cam 54 driven by shaft 52 has a cam follower arm 124 attached to the linkage 126 that drives the arm 125 which causes the nail to be pushed out of position so that it will drop under the influence of gravity to a retainer bin.

FIG. 14 sets forth in detail the assembly for a typical U-joint drive assembly 58. Bearings 162 support shaft 110, which rotates universal joint 164. A phase coupling 166 rotates in response to the universal joint and power is transmitted to drive shaft 106 and then ultimately to the pinion-driven helicon gear 104. The phase coupling 166 controls alignment of notches 117 on wheels 24 so that all five wheels have synchronized notches.

FIGS. 15 and 16 show an alternative form of the invention 10, wherein an encoder 142 provides rotary information to the servo amplifier 140 which can be pre-set to various index lengths. These in turn drive the five servo motors 144 which drive the five wheels 24.

FIGS. 18 and 19 show an alternate method for gripping and cutting the wire 14 and FIGS. 20 and 21 show the gripper **60*a* and cutter 62*a*** slide assemblies employed in the alternate method.

Lever arm 163 pivoting at 165 moves gripper assembly **60*a* in response to movement of track cam 167. Lever arm 168 pivoting at 169 moves cutter assembly 62*a* in response to the movement of cam 179. Adjustable cam wedges 171 containing teeth 173 move within housing 30*a* which has a front plate 66*a* and back plate 68*a***.

The cutter assembly **62*a* has an arm 172 held in place by gibbs 107. The gripper assembly 60*a* has a stem 177 to actuate the gripper. Gibbs 170 holds the gripper assembly 60*a*** in place.

In a second embodiment, shown conceptually in FIG. 22, the servo mechanism of the first embodiment may or may not be used as desired.

The second embodiment differs from the first embodiment in two important respects: the cross-sectional configuration of the nail produced by the machine is variable at will because the form rollers are movably mounted, and the means for heading the nails is different as well. The new means for heading the nail allows the machine to run continuously and thus doubles its efficiency.

More specifically, in the second embodiment, the configuration of the cross section of the nail includes tapered fins disposed about 98° apart, non-tapered fins, i.e., fins having a uniform width along their respective radial extents which fins are about 72° apart, and a theoretically infinite plurality of nails having tapered fins disposed between 72°–98° apart.

Each non-tapered fin has a width approximately equal to one-half the core diameter of the formed wire.

The diameter of an imaginary circle coincident with the outer edges of the non-tapered fins (which result when the form rollers are at their closest radial spacing relative to one another), is about four times greater than the diameter of the central core of the fastener. The material saved by reducing the size of the central core is added, under the influence of the rollers, to the radial extent of the fins.

The resulting nail having non-tapered fins has a surface area about 86 percent greater than the surface area of a common round shank nail. This surface area is about 60 percent greater than the surface area of the nail made by the machine of the first embodiment.

In a commercial embodiment of this invention, the fin included angle of the nails provided by following the inventive method is about 85°; thus, the fins are tapered, but less so than the fins of the 98° embodiment. The overall diameter to core diameter ratio, in the commercial embodiment, is about 3.5 to 1 and the increase in surface area is about 30% greater than the nail produced by the machine of the first embodiment.

All of the tapered fin and non-tapered fin star-shaped nails produced by the novel method use but half the materials used in a common round shank nail, and, accordingly, weigh but half as much. Due to the cold working process described herein, however, the tensile strength of the novel nails is about 120,000–150,000 pounds per square inch, more than double the tensile strength of common nails. By increasing the carbon content of the nail, the tensile strength can be increased to about 300,000 pounds per square inch.

The smallest angular relation between fins in the second embodiment is about 72° and the largest angular relation between fins is about 98°, as aforesaid. These angles are believed to be the lower and upper limits, respectively, for the angular relationships of the fins of star-shaped fasteners. Accordingly, the machine may be set up to produce nails having fin-included angles of 85°, or, for that matter, any fin-included angle between about 70°–100°. All that is needed to change the fin-included angle (and, consequently, the ratio of the overall diameter to the core diameter and the amount of taper of the fin) is to change the radial positioning of the form roller members.

In all embodiments, the forming rollers have convex annular working edges to form convex bights between contiguous fins. Moreover, in all embodiments, the radially outer edges of the fins are rounded as a result of the novel cold-working method disclosed herein.

The second of the major differences between the first and second embodiments appears in the heading mechanism.

A rotary nail-heading mechanism, intended for use in connection with common round shank nails, and of the type manufactured in Denmark by Enkotec Corporation, replaces the ram header of the first embodiment.

Since the nails are headed by the Enkotec device, the gripper housing and its parts such as the gripper heads, wire grippers, cutter heads and wire cutters are not employed. Gear box 22 is still used, but the cam indexer unit 86 is not needed due to the continuous running of the machine, i.e., the feed and rest cycle of the first embodiment is eliminated in this second embodiment. Moreover, U-joint drive assembly 160 is still employed, but kicker assembly 64 is not inasmuch as the Enkotec machine has its own kicker assembly.

After the wire 14 has been worked into its final shape, it is cut and pointed simultaneously at a pointing station and the individual nails are then pulled through feed rollers and inserted in nail-receiving pockets formed in the head of the rotating Enkotec machine. The Enkotec machine carries the nail to a heading station where a rotary mechanism is employed to head the nail, in lieu of the ram means described hereinabove.

Turning now to the drawings showing the second embodiment, it will there be observed that this embodiment of the invention includes a wire supply 12, wire straightener 16 having rollers 18 hereinbefore described and preform rollers 20. The preform rollers are shown in section in FIG. 23.

Each preform roller 20 has a substantially flat annular working edge 23*a*. Edge 23*a* may be perfectly flat, or, as preferred, it may be provided with a convexity having a radius of about 0.010 inch. When provided with a convexity, each preform roller 20 imparts a concavity to the wire having the same 0.010 radius. FIG. 26 shows the concavities 23*b* in exaggerated form; the concavities serve to facilitate the centering of the form rollers as the wire arrives at the form roller station.

FIG. 23*a* shows that the wire produced by the preform rollers has a pentagonal shape, as indicated in broken lines. The cross section of the wire after passing through the form roller station when the form rollers are in their collective outermost, intermediate and innermost positions is shown in solid lines, dotted lines and broken lines, respectively.

Form rollers 24, which are longitudinally spaced from and in axial alignment with preform rollers 20, are movably mounted and thus may be spaced apart from one another the same distance as in the first embodiment of the invention depicted in FIGS. 1–21 , in which position they would apply the same pressure to wire 14 and produce a fastener having tapered fins about 100° apart as shown in FIG. 27.

Form rollers 24 may be more closely spaced than form rollers 24 of the first embodiment and when so spaced will apply more pressure to wire 14 so that the resulting cross section of the wire is a star having a central core of reduced diameter vis a vis the core of the nail produced by the machine of the first embodiment, having fins of less taper and having fins more closely angularly spaced relative to one another.

The machine of FIG. 22 can produce fasteners where the fins are about 98° apart as shown in FIG. 27, about 85° apart as shown in FIG. 28, or about 72° as shown in FIG. 29. The overall diameter indicated in FIG. 27 is about three times greater than the indicated core diameter. The same ratio in the FIG. 29 fastener is about 4:1. The preferred commercial nail is shown in FIG. 28, has an overall diameter to core diameter ratio of about 3.5:1. Its fins are about 85° apart and are less tapered than the fins of the FIG. 27 nail. The barbs that may be applied to the nails by this inventive machine are not shown in FIGS. 27–29 because this invention also contemplates the making of a barbless nail.

Those skilled in the cold working arts will note that the pressures applied by rollers 24 will increase as they are moved closer and closer together. Whereas the preform rollers 20 apply a pressure of about 1,000 pounds per square inch, the form rollers 24 apply a pressure of about 6,000–10,000 pounds per square inch, depending upon their radial spacing.

A sectional view of the form rollers 24 appears in FIG. 24.

Transverse notches 117 may be provided to perform the skip function if it is desired to provide unformed sections to be headed. Such unformed sections of wire are denoted 46*a* in FIG. 22.

The continuous wire 14 is cut and pointed at the next station by five cut rollers 184 shown in section in FIG. 25. As shown, each roller 184 has a conical cutting and pointing means 184*a* spaced about its periphery at equally distantly spaced intervals.

The cut and pointed nails are introduced into Enkotec machine 186 by feed rollers 188.

The specific details of construction of the Enkotec machine need not be described herein, since said machine is commercially available from Enkotec Corporation. However, to provide a general overview of the machine, it is hereby pointed out that the Enkotec machine rotates in the direction of arrow 190 in FIG. 22. Each nail 46 enters longitudinally into a nail-receiving slot as depicted and is positioned by a stop member 194. The position is adjusted more precisely by a second stop member 196 prior to delivery of the nail to heading station 198. The headed nail is then kicked out of the machine by a kicker mechanism (not shown) to a bin, not shown.

To synchronize the present invention with the Enkotec heading means, a shaft driven by sun gear 90 (FIG. 8) interconnects the present invention with the Enkotec device, i.e., the Enkotec header is driven by the present invention. In lieu of said shaft, a suitable means could be employed to monitor the speed of rotation of the Enkotec machine, and a mini computer or encoder like means 142 could then be employed to drive the preceding stages of the invention, or vice versa.

One disadvantage of nails made by prior art machines is that their tensile strength is not uniform along their extent. Since the shank of a common round shank nail is not cold worked, the tensile strength of the head is substantially greater than the tensile strength of the shank of the nail when its head is formed by ramming.

Thus, another advantage of the present invention is that since the shank of the nail is cold worked, and the portion of the wire to be headed is not, the headed nail has a uniform tensile strength along its extent, i.e., the tensile strength of the shank and of the head will be substantially uniform, because the ramming of the unworked portion of the wire increases its tensile strength to that of the shank.

The holding power of the nails produced by the novel machine may be further increased by roughening the annular edges of the form rollers as by machining, acid washing, peening, sandblasting and the like; the roughened edges emboss the wire and decrease its smoothness so that it has a microfinish of about 120–150 microfinish units.

A nail produced by the novel machine when the rollers 24 are at their closest radial spacing and when barbs are desired is shown in FIGS. 30 and 31.

As shown in FIG. 30, barbs 182 are spaced along the extent of the shank of nail 46. Form rollers 24, where barbed nails are desired, are provided with plural, transversely disposed, notches 117*a* (FIGS. 22 and 24) which notches 117*a* are shallower than skip notches 117 because, unlike notches 117, they do not skip that portion of the wire entering into registration therewith. However, wire entering into registration with shallow notches 117*a* is subjected to less pressure than the unbarbed and unskipped portions of the nail.

More particularly, each notch 117*a* has a deep bight region flanked by radially diverging arms that become gradually shallower, at a linear rate of change, along their radial extents.

Said configuration of notches 117*a* produces barbs 182 (FIG. 30) which are raised at their highest point at their respective bight portions 183, as shown in FIG. 31 and which barbs reduce in height (i.e., radial distance from the nail's longitudinal axis of symmetry) in a gradual, linear manner, along their diverging radial arms 185 until said arms 185 merge in a feather edge with their associated nail fins.

Each notch 117*a* and hence each barb 182 extends longitudinally as shown in FIG. 30, decreasing in height along its longitudinal extent until it merges with the nail's concave bight region 187 (FIG. 31).

Accordingly, each flat 189 (FIG. 30) resists facile retraction of nail 46 from the wood into which it is designed to be driven.

Angle 190 (FIG. 31) is about 12°.

In a commercial embodiment of this invention, notches 117*a* are not used and the nail is thus barbless; it is a simple matter to switch to form rollers 24 having notches 117*a* if barbs are desired.

By this disclosure of a machine having form rollers, the cooperative positioning of which defines the upper and lower limits of the fin-included angles of star-shaped nails, and by the disclosure of a machine that makes star-shaped nails so that the fins have rounded ends and are either tapered or non-tapered depending upon the pressure applied by the forming rollers, with concave bights therebetween, and which nails weigh but one-half as much as conventional nails while significantly outperforming the same, the art of nail-making machines is significantly advanced and the following claims are to be interpreted broadly so as to protect the heart of this pioneering invention. Moreover, since the illustrated machines are merely illustrative of means suitable for carrying out the inventive method, this invention is not restricted to the particular machines shown and described herein.

As has been made clear, the novel method includes cold-working wire stock into a finned nail in two work stations. The rollers of the second work station may apply sufficient pressure to work the cross section of the wire into the configuration of a star having tapered fins of a first radial extent disposed about 98° from one another, or the second station rollers may apply even more pressure and work the cross section of the wire into a star configuration where the fins are of uniform width, have a greater radial extent, and have a fin-included angle of about 72°, or said rollers may apply any amount of pressure therebetween and produce fasteners where the fins are spaced 85° apart or any other spacing between about 70°–100°.

Thus, machines making star-shaped nails having fin-included angles of about 72°–98° are taught by this disclosure. For example, a machine that cold-worked wire into a cross-sectional configuration of a five pointed star where the fins are 85° apart would infringe the claims appended hereto, whether one of the machines disclosed herein was employed to make such a nail, an equivalent machine, or even an entirely different machine that still follows the inventive method.

The method disclosed herein covers skip rolling with deep, non-wire contacting notches, as well as non-skip rolling with barb-forming shallow notches.

The method has been implied in more detail throughout this disclosure, since, again, the function of a machine is to perform a method. However, the inventive methods are also set forth with particularity in the claims that follow.

INDUSTRIAL APPLICABILITY

Millions of tons of nails are used annually throughout the world. Most of the nails in use have round shanks and are therefore heavy and prone to split wood. Use of the nails made by the novel machine will slash material and shipping costs in half, eliminate wood splitting, and provide structures fastened together with stronger nails.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. In a nail-making machine that forms a continuous length of wire into individual nails of preselected length, comprising:

a preform roller station including a first set of plural rollers that are radially disposed relative to a path of travel of said wire;

each of said preform rollers having a substantially flat annular working surface;

said preform rollers specifically positioned to collectively impart a polygonal cross section to said wire;

a form roller station including a second set of plural rollers that are radially and equidistiantly disposed relative to a path of travel of said wire and equiangularly spaced relative to one another about the circumference of said wire;

each of said second set of rollers having a convex annular, working surface; means mounting said second set of rollers for radial movement between a radially innermost position, a radially outermost position, and a plurality of functional intermediate positions therebetween for forming, at each of said respective radial positions of said second set of rollers, a wire having a star-shaped cross-section including a plurality of radially-extending fin members, said fin members of said respective wires having varying angular intervals in the range of about 70°–100° therebetween; and said wire having complementally formed concave bight portions formed about its circumference by said second set of rollers, there being as many bight portions as there are rollers in said second set of rollers;

each of said bight portions being disposed intermediate a pair of said radially extending fin members, there being as many fin members as there are rollers in said second set of rollers.

2. The machine of claim 1, further comprising a cutting and pointing station to cut said wire into preselected lengths and to apply a point to the wire where cut.

3. The machine of claim 1, further comprising a rotary heading station for applying a head to said nails on a substantially continuous basis.

4. The machine of claim 3, wherein said second set of rollers, when in their radially outermost position, apply pressure sufficient to form fin members in said wire that are angularly disposed at substantially 98° intervals relative to one another.

5. The machine of claim 4, wherein the diameter of an imaginary circle coincident with radially outermost ends of said fin members is about three times greater than a diameter of a central core of said wire.

6. The machine of claim 5, wherein the number of rollers in said first and second set of rollers is five, and wherein the polygonal cross section of wire worked by said first set of rollers is a pentagon.

7. The machine of claim 6, wherein said fin members are tapered downwardly from their proximal to distal ends and terminate in a rounded distal end.

8. The machine of claim 7, wherein said nail has a surface area about 17 percent greater than the surface area of a nail having a round cross section.

9. The machine of claim 8, wherein said nail is cold-worked and as a result thereof has a tensile strength of about 120,000–150,000 pounds per square inch, and wherein said tensile strength is substantially uniform along said wire's extent.

10. The machine of claim 1, wherein said annular working surface is roughened to increase the microfinish of said nails.

11. The machine of claim 10, wherein said annular working surface is roughened by acid washing.

12. The machine of claim 1, wherein the quantity of material required to form said nail is about one-half the quantity of material required to form a nail having a shank with a round cross section.

13. The machine of claim 1, wherein said second set of rollers when positioned in their radially innermost position supply pressure sufficient to form fin members in said wire that are disposed at substantially 72° intervals relative to one another.

14. The machine of claim 13, wherein said fin members have a uniform width along their respective radial extents and terminate in a rounded distal end.

15. The machine of claim 14, wherein the diameter of an imaginary circle coincident with radially outermost edges of said fin members is about four times greater than a diameter of a central core of said wire.

16. The machine of claim 15, wherein each of said fin members has a width about one-half the diameter of a central core of said wire.

17. The machine of claim 16, wherein said nail has a surface area about 86° greater than the surface area of a nail having a round cross section.

18. The machine of claim 17, wherein said nail is cold worked and as a result thereof has a tensile strength of about 120,000–150,000 pounds per square inch, and wherein said tensile strength is substantially uniform along said wire's extent.

19. The machine of claim 18, wherein said annular working surface is roughened to increase the microfinish of said nails.

20. The machine of claim 19, wherein said working surface is roughened by machining.

21. The machine of claim 13, wherein the quantity of wire required to form said nail is about one-half the quantity of wire required to form a nail having a round shank.

22. The machine of claim 2, wherein said cutting and pointing station includes five rollers radially disposed in relation to a path of travel of said wire, each of said rollers having conical point members positioned at equidistantly and circumferentially spaced intervals along a working annular surface thereof.

23. The machine of claim 22, further comprising a feed roller station including a pair of cooperative roller members that deliver a pointed and cut length of wire to said rotary heading station and deposit said lengths of wire into said rotary heading station.

24. The machine of claim 23, further comprising a substantially continuous supply of wire and a wire straightener means positioned between said supply of wire and said preform roller stage.

25. The machine of claim 1, wherein each of said second set of rollers has plural wire-skipping notches formed at equidistantly spaced intervals about its annular working edge.

26. The machine of claim 25, wherein each of said second set of rollers has plural barb-forming notches formed at equidistantly spaced intervals about its annular working edge to form barb members along the extent of said wire.

27. The machine of claim 1, wherein each of said second set of rollers has plural wire-skipping notches formed at equidistantly spaced intervals about its annular working edge.

28. The machine of claim 27, wherein each of said second set of rollers has plural barb-forming notches formed at equidistantly spaced intervals about its annular working edge to form barb members along the extent of said wire.

29. The machine of claim 4, wherein each of said second set of rollers has plural wire-skipping notches formed at equidistantly spaced intervals about its annular working edge.

30. The machine of claim 29, wherein each of said second set of rollers has plural barb-forming notches formed at equidistantly spaced intervals about its annular working edge to form barb members along the extent of said wire.

31. The machine of claim 13, wherein each of said second set of rollers has plural wire-skipping notches formed at equidistantly spaced intervals about its annular working edge.

32. The machine of claim 31, wherein each of said second set of rollers has plural barb-forming notches formed at equidistantly spaced intervals about its annular working edge to form barb members along the extent of said wire.

33. The machine of claim 1, wherein said second set of rollers, when positioned in an intermediate radial position substantially equidistant from its radially outermost and innermost positions, supply pressure sufficient to form fin members in said wire that are angularly disposed at substantially 85° intervals relative to one another.

34. The machine of claim 33, wherein said fin members are tapered along their radial extent.

35. The machine of claim 34, wherein the diameter of an imaginary circle coincident with radially outermost edges of said fin members is between three to four times greater than a central core of said wire.

36. The machine of claim 35, wherein the number of rollers in said first and second set of rollers is five, and wherein the polygonal cross section of wire worked by said first set of rollers is a pentagon.

37. The machine of claim 36, wherein a nail made by said machine has a surface area about 50% greater than the surface area of a nail having a round cross section.

38. The machine of claim 37, wherein said nail is cold-worked and as a result thereof has a tensile strength of about 120,000–150,000 pounds per square inch, and wherein said tensile strength is substantially uniform along said wire's extent.

39. The machine of claim 38, wherein said annular working surface is roughened to increase the microfinish of said nails.

40. The machine of claim 39, wherein the quantity of material required to form said nail is about one-half the quantity of material required to form a nail having a shank with a round cross section.

41. The machine of claim 33, wherein each of said second set of rollers has plural wire-skipping notches formed at equidistantly spaced intervals about its annular working edge.

42. The machine of claim 41, wherein each of said second set of rollers has plural barb-forming notches formed at equidistantly spaced intervals about its annular working edge to form barb members along the extent of said wire.

43. A nail-making machine, comprising:

a wire supply means for supplying wire having a round cross section to said machine on a substantially continuous basis;

a wire straightening means;

a preform roller station;

said preform roller station including five preform roller members having substantially flat annular edges to form said wire having a round cross section into wire having a generally pentagonal cross section;

a form roller station being axially aligned and longitudinally spaced in relation to said preform roller station;

said form roller station including five form roller members radially and equidistantly disposed with respect to a path of travel of said wire, said path of travel being coincident with a longitudinal axis of symmetry of said wire;

said form roller members being equiangularly spaced relative to one another about the circumference of said wire;

each of said form roller members having plural deep notches formed on its outer edge at equidistantly spaced intervals to skip roll said wire;

means mounting said form roller member at radial positions which are spaced from the longitudinal axis of symmetry of said wire by a radial distance effective for forming said wire into a star-shaped cross-section including five radially-extending fins which are tapered along their radial extent, said fins having angular intervals of about 85° therebetween;

said fins being of a common radial length and having their respective outermost edges coincident with an imaginary circle the diameter of which is between three to four times greater than a core diameter of said wire;

a pointing and cutting station including plural cutter roller members having pointed projections formed on their respective outermost edges at equidistantly spaced intervals, said pointing and cutting station operative to cut preselected lengths of wire; and a nail-heading station;

whereby wire is formed into nails having a non-circular cross section.

44. The machine of claim 43, wherein said mounting means is further provided with means for positioning said form roller members for radial movement between a radially innermost position, a radially outermost position, and a plurality of functional intermediate radial positions therebetween for forming, at each of said respective radial positions of said form roller members, a wire having a star-shaped cross-section including five radially-extending fins, said fins of said respective wires having varying angular intervals in the range of about 70°–100° therebetween.

45. The machine of claim 43, wherein each of said form roller members has a convex annular working edge and imparts a concave bight along the extent of said wire between each fin.

46. The machine of claim 45, wherein said convex annular working edge has a radius between 0.003–0.006 inch which imparts the same radius to each of said concave bights.

47. The machine of claim 43, wherein each of said preform roller members annular edges are slightly convex, having a radius of about 0.010 inch to impart a concavity to said wire having the same radius to thereby enhance centering of said form roller members with respect to said flats.

48. The machine of claim 43, wherein said nail-heading station is a rotary heading means.

49. The machine of claim 43, wherein each fin has a rounded outer edge.

50. The machine of claim 49, further comprising plural, shallow notches formed on each of said form roller members, between each circumferentially spaced pair of deep notches there being plurality of said shallow notches, and said shallow notches being specifically configured and dimensioned to form retraction-resistant barb members along the extent of said wire.

* * * * *